US010132112B2

(12) United States Patent
Yu et al.

(10) Patent No.: US 10,132,112 B2
(45) Date of Patent: Nov. 20, 2018

(54) DOOR OPERATING APPARATUS, VEHICLE HAVING THE SAME AND METHOD FOR CONTROLLING THE APPARATUS

(71) Applicant: HYUNDAI MOTOR COMPANY, Seoul (KR)

(72) Inventors: Seung Won Yu, Seoul (KR); Ki Eun Kim, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 89 days.

(21) Appl. No.: 15/348,031

(22) Filed: Nov. 10, 2016

(65) Prior Publication Data

US 2017/0275940 A1 Sep. 28, 2017

(30) Foreign Application Priority Data

Mar. 22, 2016 (KR) ..... 10-2016-0033928

(51) Int. Cl.
*E05F 15/75* (2015.01)
*E05F 15/603* (2015.01)
*E05F 15/76* (2015.01)

(52) U.S. Cl.
CPC ..... *E05F 15/75* (2015.01); *E05F 15/603* (2015.01); *E05F 15/76* (2015.01); *E05Y 2900/531* (2013.01)

(58) Field of Classification Search
CPC ..... E05F 15/75; E05F 15/603; E05F 15/76; E05Y 2900/531
USPC ..... 296/146.4, 146.9, 190.11, 223
See application file for complete search history.

(56) References Cited

U.S. PATENT DOCUMENTS 5,836,639 A * 11/1998 Kleefeldt ..... E05B 81/22 296/155
6,089,649 A * 7/2000 Hamada ..... B60J 5/062 292/201
8,360,505 B2 * 1/2013 Iijima ..... E05F 15/77 296/146.4

(Continued)

FOREIGN PATENT DOCUMENTS

JP 2005-146599 A 6/2005
JP 2012-508336 A 4/2012

(Continued)

OTHER PUBLICATIONS

Translation of Korean Notice of Allowance dated Jul. 20, 2017 issued from the corresponding Korean Patent Application No. 10-2016-0033928.

*Primary Examiner* — Jason S Morrow
*Assistant Examiner* — E Turner Hicks
(74) *Attorney, Agent, or Firm* — Brinks Gilson & Lione

(57) ABSTRACT

A door operation apparatus for a vehicle is provided to open or shut a door at a speed corresponding to a user's force or information selected by the user. In particular, the door operating apparatus installed in a body to open and shut an internal room of the body includes: a power member connected to the door for applying a moving force to the door; a detector for detecting a force applied by the user to the door; a controller for determining an open and shut speed corresponding to the detected force and controlling the power member to be driven to open and shut the door at the determined open and shut speed; and a driver for driving the power member based on a command from the controller.

19 Claims, 23 Drawing Sheets

(56) References Cited

U.S. PATENT DOCUMENTS

| | | | | |
|---|---|---|---|---|
| 8,613,160 | B2 * | 12/2013 | Matsumoto | E05B 79/20 49/279 |
| 2003/0025337 | A1 * | 2/2003 | Suzuki | E05B 81/20 292/195 |
| 2008/0048846 | A1 * | 2/2008 | Nagai | B60R 25/24 340/426.17 |
| 2015/0057895 | A1 * | 2/2015 | Yamada | E05F 15/70 701/49 |

FOREIGN PATENT DOCUMENTS

| | | | |
|---|---|---|---|
| JP | 2013-119752 | A | 6/2013 |
| KR | 10-0666666 | B1 | 1/2007 |
| KR | 10-0990809 | B1 | 10/2010 |
| KR | 10-2011-0060537 | A | 6/2011 |
| KR | 10-2011-0099104 | | 9/2011 |
| KR | 10-2015-0022030 | | 3/2015 |
| KR | 10-2015-0022030 | A | 3/2015 |

* cited by examiner

DOOR OPERATING APPARATUS, VEHICLE HAVING THE SAME AND METHOD FOR CONTROLLING THE APPARATUS

CROSS-REFERENCE TO RELATED APPLICATION

This application claims priority to and the benefit of Korean Patent Application No. 10-2016-0033928, filed on Mar. 22, 2016, which is incorporated by reference in its entirety.

FIELD

Forms of the present disclosure relate to a door operating apparatus for automatically opening and closing a door, vehicle having the same, and method for controlling the apparatus.

BACKGROUND

The statements in this section merely provide background information related to the present disclosure and may not constitute prior art.

Vehicles are machines that drive wheels for the purpose of transportation of humans or goods, and move on the road.

The vehicle may be equipped with driver and passenger seats, a back seat, a trunk into which things are loaded, and may have doors to open and shut such space.

Generally, vans or sport utility vehicles (SUVs) have a back door that can be pushed open upwards and pushed shut downwards (i.e., a tailgate) to open and close the trunk through hinges.

The vehicle may further include a lifter connected to the car body and the door for enabling the door to be easily opened by applying auxiliary force to the door if the door is opened by the user's force to a certain extent.

The lifter allows the door to be easily raised by applying the auxiliary force to the door as the lifter is stretched due to repulsive force of compressed gas filled therein, and to remain at its position not to fall while the door is fully open.

Occasionally, the door of the vehicle may not be shut tight or may be slammed shut.

For example, if the force to shut the door is too weak, the door may not be shut tight, which leads to taking the trouble of opening and shutting the door repeatedly.

Furthermore, if the drivers keep driving his and her car without knowing that the door is not shut tight, there is a possibility for an accident to occur.

On the other hand, if the force to shut the door is too strong, the noise and impact produced when the door is slammed shut may give unpleasant feeling to people in the car.

SUMMARY

The present disclosure provides a door operating apparatus, vehicle having the same, and method for controlling the apparatus, by which doors is opened or shut at a speed corresponding to the user's force.

The present disclosure also provides a door operating apparatus, vehicle having the same, and method for controlling the apparatus, by which doors is opened or shut at a speed corresponding to information selected by the user.

In accordance with an aspect of the present disclosure, a door operating apparatus is installed in a body for operating a door to open and shut an internal room of the body, and the door operating apparatus includes: a power member connected to the door for applying a moving force to the door; a detector for detecting a force applied by a user to the door; a controller for determining an open and shut speed corresponding to the detected force and controlling the power member to be driven to open and shut the door at the determined open and shut speed; and a driver for driving the power member based on a command from the controller.

The detector comprises a hall sensor arranged on one side of the power member, for outputting a signal corresponding to a change in position of the power member. The controller determines a signal received from the hall sensor while the driver is inactivated as a force from the user.

In accordance with another aspect of the present disclosure, a door operating apparatus installed in a body for operating a door to open and shut an internal room of the body, the door operating apparatus includes: a power member connected to the door for applying a moving force to the door; a control unit controlled or manipulated by the user; a controller for determining an open and shut speed corresponding to control information of the control unit and controlling the power member to be driven to open and shut the door at the determined open and shut speed; and a driver for driving the power member based on a command from the controller.

The control information comprises the number of control times the control unit is controlled, or control time for which the control unit is controlled.

The door operating apparatus further includes: a communication unit for communicating with a remote control. The controller determines an open and shut speed corresponding to control information received by the communication unit from the remote control.

In accordance with another aspect of the present disclosure, a door operating apparatus installed in a body for operating a door to open and shut an internal room of the body, the door operating apparatus includes: a power member connected to the door for applying a moving force to the door; a communication unit for communicating with a remote control; a controller for determining an open and shut speed corresponding to control information of the remote control and controlling the power member to be driven to open and shut the door at the determined open and shut speed; and a driver for driving the power member based on a command from the controller.

The control information comprises the number of control times the remote control is controlled, or control time for which the remote control is controlled.

In accordance with another aspect of the present disclosure, a vehicle includes: a car body; a door installed on the car body for opening and shutting an internal room; and a door operating apparatus for automatically opening and shutting the door, wherein the door operating apparatus includes a power member connected to the door for applying a moving force to the door, a detector for detecting a force applied by a user to the door, a controller for controlling the power member to be driven to open and shut the door at an open and shut speed corresponding to the detected force, and a driver for driving the power member based on a command from the controller.

The detector comprises a hall sensor arranged on one side of the power member, for outputting a signal corresponding to a change in position of the power member.

The door operating apparatus further comprises a communication unit for communicating with a remote control. The controller determines an open and shut speed corresponding to control information received by the communication unit from the remote control.

In another aspect of the present disclosure, a vehicle includes: a car body; a door installed on the car body for opening and shutting an internal room; and a door operating apparatus for automatically opening and shutting the door, wherein the door operating apparatus comprises a power member connected to the door for applying a moving force to the door, a control unit controlled or manipulated by the user, a controller for controlling the power member to be driven to open and shut the door at an open and shut speed corresponding to control information of the control unit, and a driver for driving the power member based on a command from the controller.

The door operating apparatus further comprises a communication unit for communicating with a remote control. The controller determines an open and shut speed corresponding to control information received by the communication unit from the remote control.

The control unit comprises at least one of a control system arranged in a handle of the door or a control system arranged in a panel of the door.

The vehicle further includes: at least one of a control system arranged in an overhead console of the internal room for receiving a command to open and shut the door or a control system arranged on a center fascia for receiving a command to open and shut the door.

The vehicle further includes: a user interface arranged on a cluster in the internal room for receiving an open and shut speed of the door.

The vehicle further includes: a detector for detecting a force applied by a user to the door, and wherein the controller determines an open and shut speed corresponding to the detected force.

The vehicle further includes: a user interface arranged on a cluster of the internal room for receiving an open and shut speed of the door and inputting or outputting open and shut setting information for the door. The open and shut setting information for the door comprises at least one of open and shut settings according to control of the control unit, detection of the detector, input through the user interface, and a reference speed.

In another form of the present disclosure, a method for controlling operation of a door of a vehicle to open and shut an internal room of the vehicle, the method includes: determining an open and shut speed of the door corresponding to information input by a user; controlling a power member arranged in the door to open the door at the determined open and shut speed if the door is shut; and controlling the power member to shut the door at the determined open and shut speed if the door is open.

The determining an open and shut speed of the door corresponding to information input by a user include: detecting a force applied by the user to the door by means of a detector, and determining an open and shut speed corresponding to the detected force.

The determining an open and shut speed of the door corresponding to information input by a user include: determining an open and shut speed corresponding to control information input by the user to a control unit; determining an open and shut speed corresponding to information input by the user to a user interface; and determining an open and shut speed corresponding to control information input by the user to a remote control.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
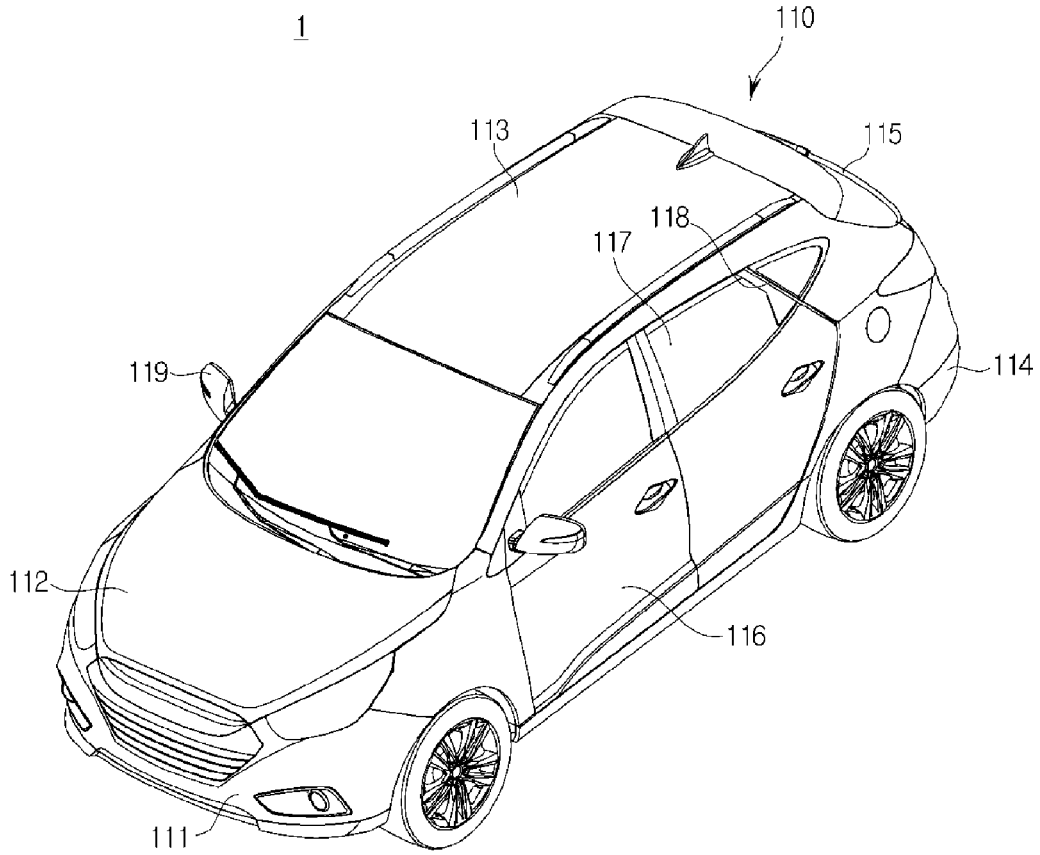
FIG. 1 shows the exterior of a vehicle according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
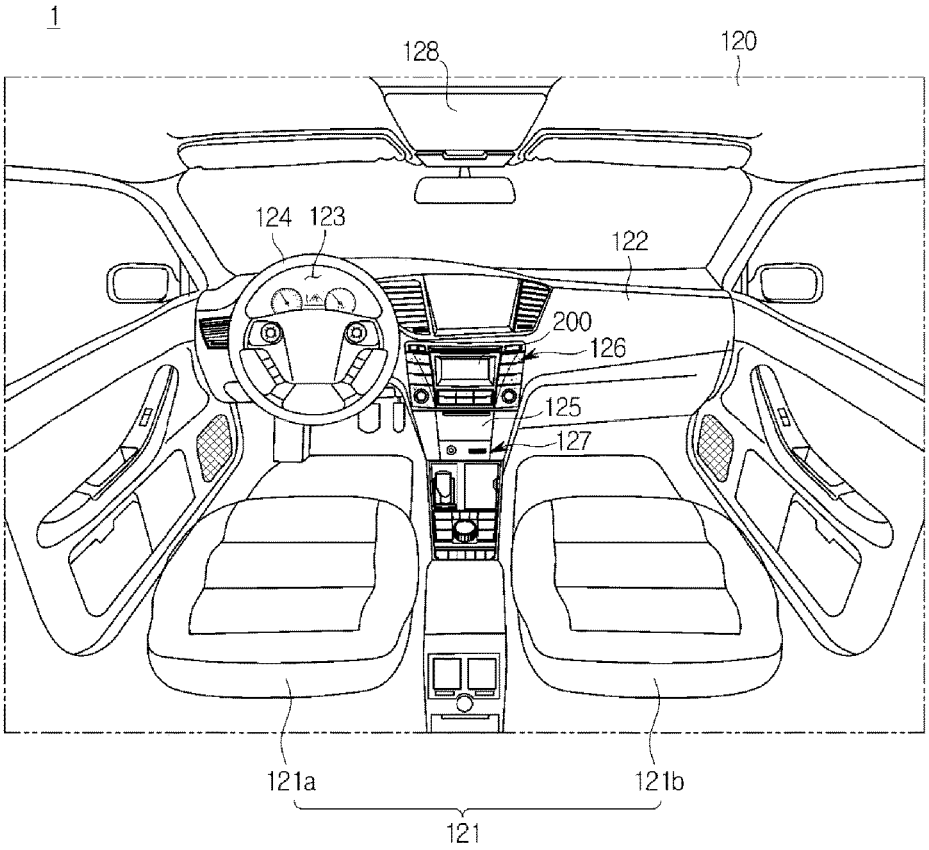
FIG. 2 shows the interior of the vehicle shown in FIG. 1.

FIG. 1 shows a vehicle equipped with an antenna device, according to one form of the present disclosure, and FIG. 2 shows the interior of the vehicle shown in FIG. 1.

Vehicle 1 may be a device that drives wheels for the purpose of transportation of humans or goods moves on the road.

The vehicle 1 includes a car body with exterior and interior parts, and remaining part, i.e., chassis on which mechanical devices desired for driving are installed.

Referring to FIG. 1, an exterior part 110 of the car body includes a front bumper 111, a hood 112, a roof panel 113, and a rear bumper 114.

An exterior part 110 of the car body may further include a door (or tailgate) 115 for opening or shutting a trunk that forms a room for keeping load, and doors 116 for opening or shutting the space where people are seated.

The doors 116 may be mounted to the sides of the driver's seat and passenger's seat.

The doors 116 may also be optionally mounted to the left and right sides of the back seat, if the back seat is equipped in the vehicle.

These doors 115 and 116 may be automatically opened or shut based on information input by the user.

Configurations for automatic operation of the doors 115 and 116 will be described in more detail later.

The exterior part of the car body may further include window glasses 117 and fillers 118 arranged on the borders between the front, back, left and right window glasses 117.

The window glasses 117 include side window glasses, quarter window glasses installed between the fillers 118, which may not be opened, a rear window glass installed on the back, a front window glass installed on the front.

The exterior part of the car body further includes side mirrors 119 that helps the driver see areas behind the vehicle 1.

Referring to FIG. 2, an interior part 120 of the car body includes seats 121 (121*a* and 121*b*), a dashboard 122, an instrument cluster (or cluster) 123 placed on the dashboard, containing gauges and indicators, such as a tachometer, speedometer, water temperature gauge, fuel gauge, turn signal indicator, head light indicator, warning light, seat belt warning light, odometer, gearshift position indicator, door open warning light, low fuel warning light, low oil pressure warning light, etc., a steering wheel 124 for steering control of the vehicle, and a center fascia 125 having a control pad for audio system and air conditioning (AC) and ventilation system.

The seats 121 include a driver seat 121*a*, a passenger seat 121*b*, and a back seat arranged in the back of the interior of the vehicle 1.

The cluster 123 may be digitally implemented. The digitally implemented cluster displays car information and traveling information in images.

The cluster 123 may further include a user interface for receiving commands from the user, and outputting operation information in response to an input from the user and traveling information of the vehicle.

The center fascia 125 is formed on the dashboard between the driver seat 121*a* and the passenger seat 121*b*.

The center fascia 125 includes a head unit 126 for controlling an audio system, an air conditioner (AC) system, and a seat heater.

A plurality of control systems, air vents, a cigar jack, etc., may be installed on the center fascia 125 and there may be a multi-terminal 127 installed on or near the center fascia 125.

The multi-terminal 127 may be arranged to be close to the head unit 146, including a universal serial bus (USB) port and an auxiliary (AUX) terminal, and optionally an SD slot.

There may also be a terminal mounted on the center fascia 125 for receiving information from the user and outputting corresponding results.

The terminal may perform at least one of navigation, DMB, audio, and video functions, and display road condition information, driving information, and the like, while in the autonomous driving mode.

The terminal may also be detachably installed on the dashboard.

The interior part 120 of the body may further include an overhead console 128 located around a room mirror.

An indoor light, a plurality of control systems, and a cabinet box may be optionally built in the overhead console 128.

The chassis of the vehicle further includes a power generating system, a power transfer system, a traveling gear, a steering system, a braking system, a suspension system, a transmission system, a fuel system, front, rear, left, and right wheels, etc.

The vehicle further includes various safety systems for safety of the driver and passengers.

The safety systems may include an airbag control unit for the purpose of the safety of driver and passengers in case of car crashes and an Electronic Stability Control (ESC) unit for stabilizing the vehicle's position while the vehicle 1 is accelerating or cornering.

The vehicle 1 further includes a battery (not shown) electrically connected to the terminal, audio system, indoor lighting system, start motor, and other electronic devices for supplying power.

The battery is charged by means of dynamic power of the internal generator or the engine while the vehicle is being driven.

Figure 3:
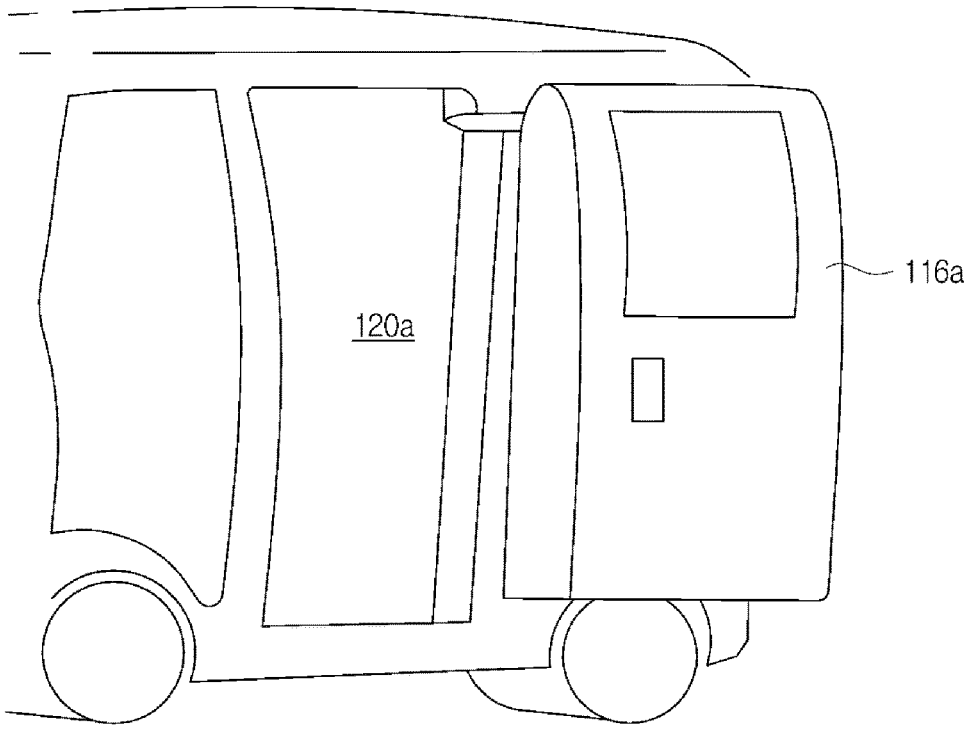
FIGS. 3 to 5 show car doors equipped with a door operating apparatus according to forms of the present disclosure.
Figure 4:
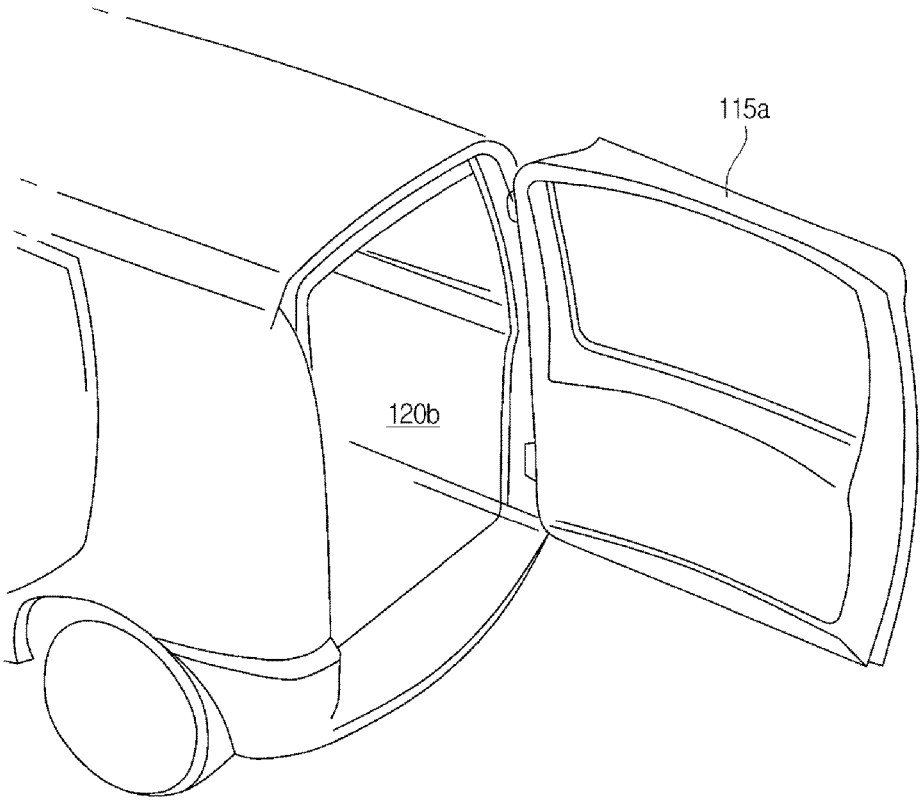
Figure 5:
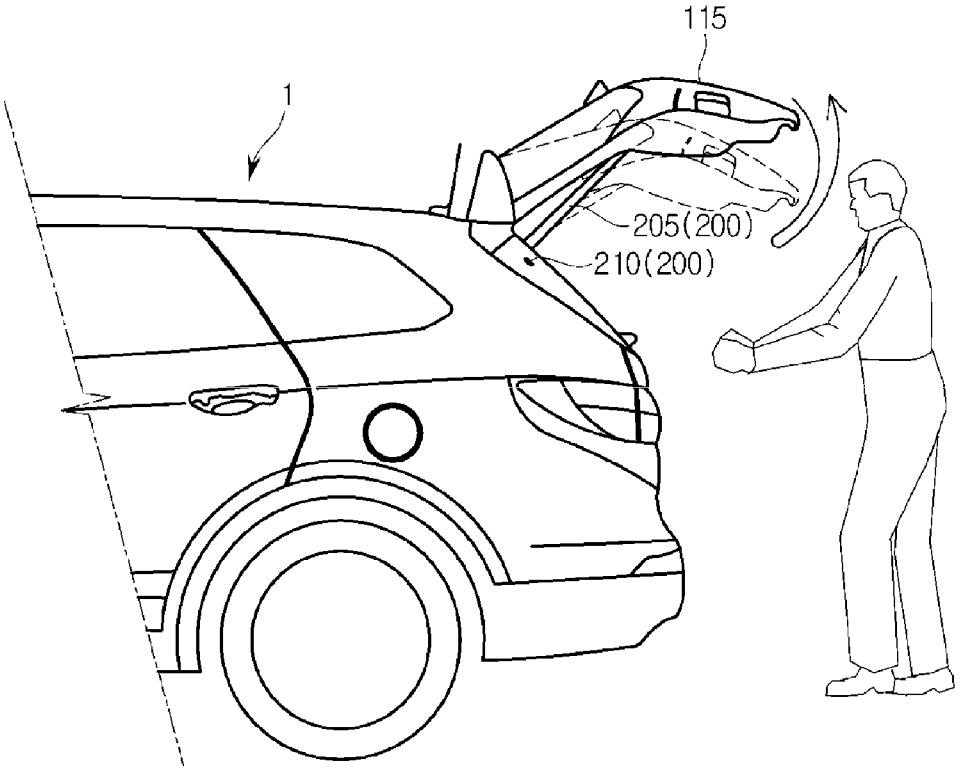

FIGS. 3 to 5 show car doors equipped with a door operating apparatus according to one form, FIGS. 3 and 4 show doors equipped in a van, and FIG. 5 shows a door equipped in a car.

Vehicles may be classified into cars, coaches (or buses), trucks, special vehicles, etc., by use.

Among them, cars may include ones for carrying up to about six people and ones about nine people.

Cars may be subdivided into sedan, coupe, wagon, sport utility vehicle (SUV), convertible, hatchback, limousine, and van by shape, size, and usage of the car.

Vehicles may have doors that may be opened or shut in different ways depending on types of the vehicles and positions in which the doors are installed.

Referring to FIG. 3, a van may include a door 116*a* for opening or shutting an internal room 120*a* of the back seat, and the door 116*a* may slide open and shut to the left and right.

Referring to FIG. 4, a van may include a door 115*a* for opening or shutting an internal room 120*b* of the trunk, and the door 115*a* may be pivoted on a vertical axis to be opened and shut.

Referring to FIG. 5, a car may include a door 115 for opening or shutting an internal room of the trunk formed on the back of the car body, and the door 115 may be pivoted on a horizontal axis to be opened and shut.

The doors 115, 115*a*, and 116*a* may be automatically opened or shut by a door operating apparatus 200 equipped in the doors.

The door operating apparatus 200 for opening or shutting the door 115 attached to the car trunk will now be described.

The door operating apparatus 200 will be described in connection with FIGS. 5 to 7.

Figure 6:
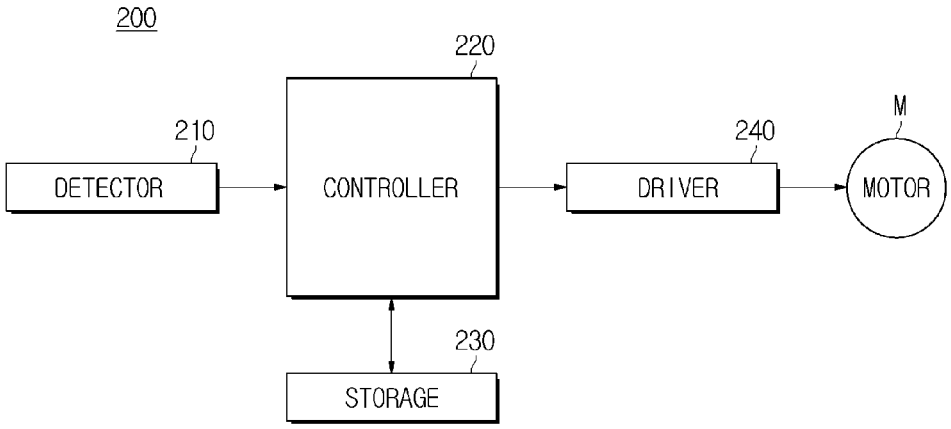
FIG. 6 is a control block diagram of a door operating apparatus according to one form of the present disclosure.

FIG. 5 shows a vehicle equipped with the door operating apparatus 200, and FIG. 6 is a control block diagram of the door operating apparatus 200.

As shown in FIG. 5, the vehicle may include a door 115 for opening or shutting an internal room of the trunk, and the door operating apparatus 200 for opening or shutting the door 115.

The door operating apparatus 200 may include a power member 205 for applying a moving force to the door 115, and a detector 210 arranged on one side to the power member 205 for detecting the force the user applies to the door 115.

The power member 205 has one end attached to the door 115 and the other end attached to the car body.

The one end of the power member 205 may be mounted such that it may be pivoted in the vertical direction of the car body.

The one end of the power member 205 is pivoted up or down by the force delivered once the user's force has been applied to the door 115, and is pivoted in the other direction by repulsive force to return to its original position.

At this time, a change in position (i.e. a pivot angle) made at the one end of the power member 205 is detected by the detector 210.

Briefly explaining the configuration of the power member 205, the power member may include an outer housing that forms the exterior of the power member, a rotation member arranged inside the outer housing, a motor for applying turning force to the rotation member, an inner housing movably arranged inside the outer housing and combined with the rotation member to be moved from the inside of the outer housing to the outside of the outer housing in a straight line by rotation of the rotation member.

The power member 205 may be adjusted in length by rotation of the motor.

The door operating apparatus may be arranged in the door, and may further include a latch (not shown) for locking or unlocking the door.

The latch electrically pulls the door using a latch motor if the door approaches a latching position, and electrically unlocks the door to be open using the latch motor if a signal to open the door is input.

The detector 210 is mounted on the car body, and more particularly, on a connection part of the power member 205 to detect the change in position of the one end of the power member 205.

The detector 210 may include a hall sensor for detecting a pivot angle of the one end of the power member 210 when the one end of the power member 205 is pivoted by the user's force applied to the door.

The detector 210 may include one or two hall sensors.

In one form, the detector 210 may include a force sensor arranged in e.g., a handle of the door for detecting a force applied by the user.

FIG. 6 is a control block diagram of a door operating apparatus, and the door operating apparatus includes a detector 210, a controller 220, a storage 230, and a driver 240.

The detector 210 detects a force applied to the door 115 by the user.

The detector 210 may include a hall sensor for outputting a signal corresponding to a change in position of the power member 205.

The detector 210 may include two hall sensors. Accordingly, it may also detect a direction in which the force is applied.

The controller 220 checks information about the detected force and determines a speed at which the door is opened or shut (hereinafter, referred to as open and shut speed), which corresponds to the information about the force.

The information about the force as herein used may correspond to a magnitude of the force.

The open and shut speed includes a speed at which the door is opened (simply called an open speed) and a speed at which the door is shut (shut speed).

The controller 220 determines a current state of the door, and controls the power member to be driven to open the door at the determined open speed if the door has been shut, or controls the power member to be driven to shut the door at the determined shut speed if the door has been open.

For example, the controller 220 may control the open and shut speed to be high, middle, and low if the magnitude of the force is in high, middle, and low ranges, respectively.

The controller 220 may determine whether the door is open or shut based on whether the door is locked or unlocked.

Furthermore, it is also possible that the controller 220 determines whether the door is open or shut based on sensing information from a door open and shut sensor (not shown).

In the case that there are two hall sensors, the controller 220 may determine a direction in which force is applied and a magnitude of the force based on information about the force detected by the two hall sensors, may recognize the intention of the user of whether to open or shut the door based on the determined direction of the force, and may control the open and shut speed of the door based on the determined magnitude of the force.

Specifically, the controller 220 may control the door to be opened at an open speed corresponding to the magnitude of the force if recognizing that the user intends to open the door, and may control the door to be shut at a shut speed corresponding to the magnitude of the force if recognizing that the user intends to shut the door.

The controller 220 may output a pulse-width controlled signal corresponding to the determined open and shut speed of the door.

The controller 220 may be an electric control unit (ECU) built into the vehicle.

The controller 220 may also be a control processing unit (CPU), micro computer unit (MCU), or a processor.

The storage 230 stores open speeds and shut speeds corresponding to magnitudes of the force.

For example, the storage 230 may store respective information about magnitudes of forces corresponding to high, middle, and low, and respective information about speeds corresponding to high, middle, and low.

If magnitudes of the force are the same, the open speed and shut speed of the door may be the same.

On the other hand, even if magnitudes of the force are the same, the open speed and the shut speed may be different.

The storage unit 230 may include storage media in at least one of flash memory, hard disk, multimedia card micro type memory, card type memory (e.g., SD or XD memory), Random Access Memory (RAM), Static Random Access Memory (SRAM), Read-Only Memory (ROM), Electrically Erasable Programmable Read-Only Memory (EEPROM), Programmable Read-Only Memory (PROM), magnetic memory, magnetic disk, and optical disk.

The driver 240 may drive a motor M arranged in the power member 205 based on a command from the controller 220.

Specifically, the driver 240 may control the rotation speed of the motor M by controlling the pulse width of current or voltage to control current or voltage applied to the motor M.

Accordingly, it may control the open and shut speed of the door by controlling the speed at which the power member that connects the car body and the door is stretched.

Figure 7:
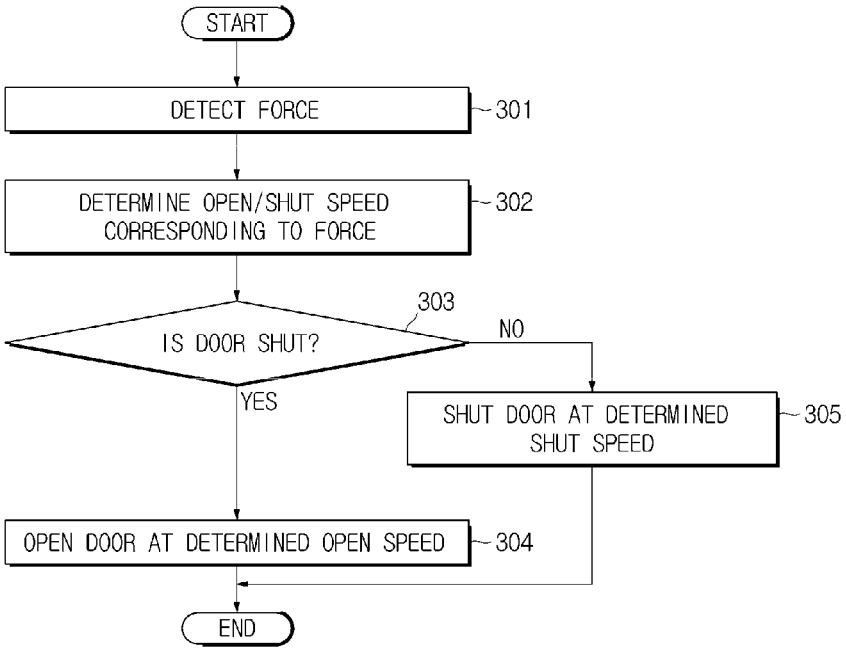
FIG. 7 is a flowchart of controlling a door operating apparatus according to one form of the present disclosure.

FIG. 7 is a flowchart of controlling a door operating apparatus to describe operation of opening and shutting a door of a vehicle.

The door operating apparatus of a vehicle detects a force applied to the door using a detector in operation 301.

Detecting the force applied to the door includes receiving a signal output from the detector and recognizing the force by processing the received signal.

The received signal may be a signal corresponding to information detected by the detector, and may include information about a magnitude of force.

Furthermore, the door operating apparatus determines whether the door is moving (to be opened or shut), and if the door is moving, determines the signal output from the detector as a signal produced by the detector according to door operating control and ignores the signal.

Given that the state, in which the door is moving, corresponds to a state in which a control signal for the motor is being output from the driver, it is also possible to ignore the signal from the detector based on an operation state of the driver.

Specifically, the door operating apparatus may recognize a signal output from the detector as a signal produced by the detector according to the user's force, if it is determined that the door is not moving, i.e., if the driver is not working, and may then control opening and shutting of the door based on the received signal.

The door operating apparatus of the vehicle determines an open and shut speed corresponding to a magnitude of the force, in operation 302.

Next, the door operating apparatus determines whether the door is currently shut, in operation 303.

Determining the current state of the door includes determining a current state of the door based on whether the latch is locked or unlocked, or determining a current state of the door based on sensing information from the open and shut sensor.

If it is determined that the door is currently shut, the door operating apparatus controls the door to be unlocked and then opened at the determined speed, in operation 304.

Otherwise, if it is determined that the door is currently open, the door operating apparatus shuts the door at the determined shut speed, in operation 305, and controls the door to be locked once the door is shut.

The opening of the door includes stretching the power member that connects the car body and the door, so that moving force is applied to the door in a first direction.

The shutting of the door includes contracting the power member that connects the car body and the door, so that moving force is applied to the door in a second direction.

The door operating apparatus increases the open and shut speed the larger the magnitude of the force applied in opening and shutting the door, and decreases the open and shut speed the smaller the magnitude of the force.

Increasing the open and shut speed includes increasing a rate at which the length of the power member is changed, by controlling pulse width of current or voltage applied to the motor to increase turning speed of the motor. Decreasing the open and shut speed includes decreasing a rate at which the length of the power member is changed, by controlling pulse width of current or voltage applied to the motor to decrease turning speed of the motor.

Furthermore, the door operating apparatus may determine a direction in which a force is applied (upward or downward with respect to the direction of gravity) and a magnitude of the force, based on signals received from the two hall sensors of the detector, may determine that the door is intended to be open and may open the door at an open speed corresponding to the determined magnitude of the force if the determined direction of the force is upward, and may determine that the door is intended to be shut and may shut the door at a shut speed corresponding to the determined magnitude of the force if the determined direction of the force is downward.

Figure 8:
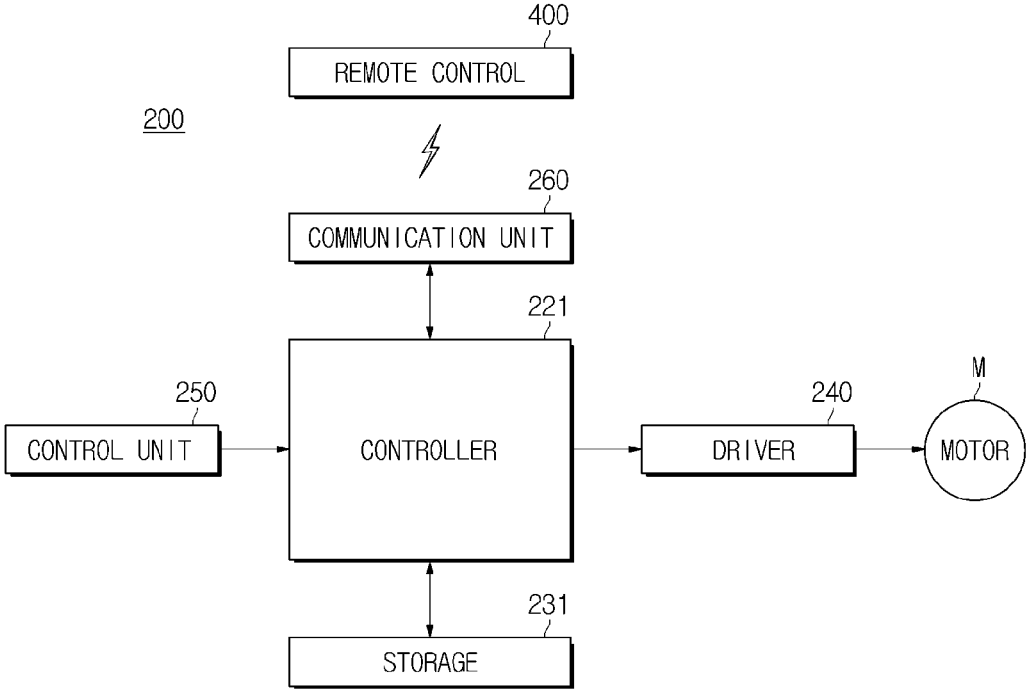
FIG. 8 is a control block diagram of a door operating apparatus according to another form of the present disclosure.

FIG. 8 is a control block diagram of a door operating apparatus, and the door operating apparatus may include a control unit 250, a controller 221, a storage 231, and a driver 240, and may further include a communication unit 260 that communicates with a remote control 400.

The control unit 250 may be controlled by the user for receiving control information from the user.

The control unit 250 may be implemented as a control system, such as a button (or buttons), a switch (or switches), etc.

This will be described in connection with FIGS. 9 to 12.

Figure 9:
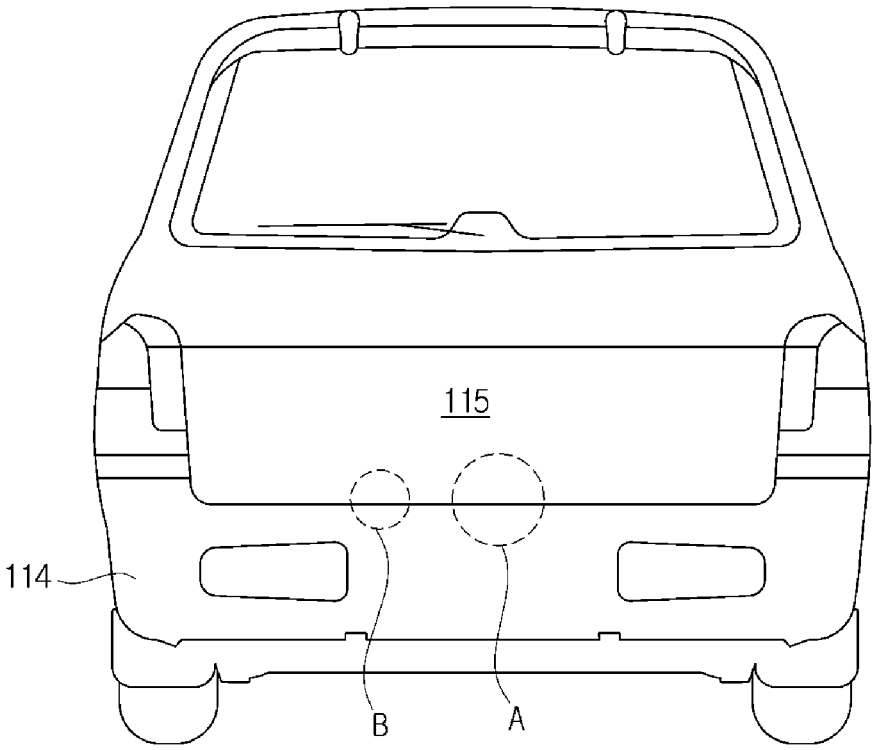
FIG. 9 is a rear view of a vehicle having a door operating apparatus according to another form of the present disclosure.

FIG. 9 is a rear view of a vehicle, and particularly, illustrates the door 115 equipped with the control unit 250 to open or shut an internal room of the trunk.

Referring to FIG. 9, the control unit 250 may be located on the inner or outer side of the door 115.

Figure 10:
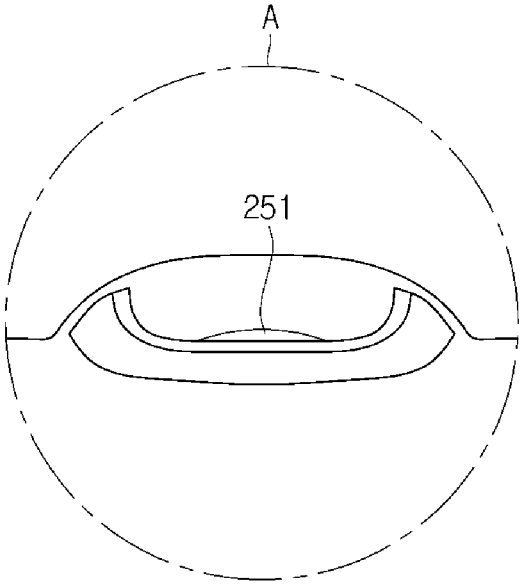
FIGS. 10 to 12 show control units equipped in the vehicle of FIG. 9.

FIG. 10 shows the control unit 250 arranged in area A of FIG. 9, and the control unit 250 may include a control system 251 of a switch type, which is equipped in the handle of the door.

Figure 11:
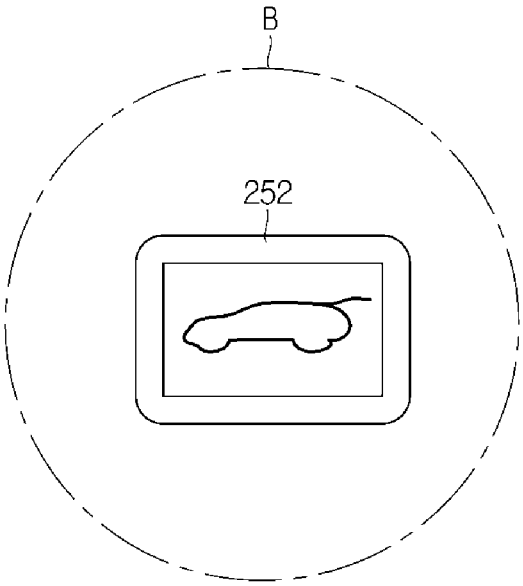

FIG. 11 shows the control unit 250 arranged in area B of FIG. 9, and the control unit 250 may include a control system 252 of a button type, which is equipped in a panel inside the door.

Figure 12:
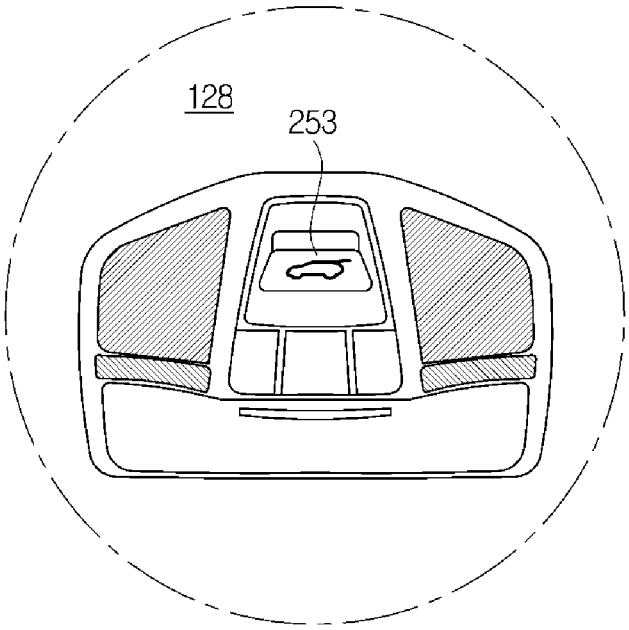

FIG. 12 shows the control unit 250 equipped in a vehicle having the door operating apparatus, and the control unit 250 may include a control system 253 of a button type, which is arranged in the overhead console 128 inside the vehicle.

In addition, the control unit 250 may further include a control system arranged on the dashboard, in particular, around the footrest or on the center fascia.

The communication unit 260 performs remote communication with the remote control 400.

The communication unit 260 receives signals from the remote control 400 and forwards them to the controller 221.

The signal from the remote control 400 may include control information of the control system.

The control information may include control time, i.e., time for which the control action or manipulation is performed, or the number of control times, i.e., the number of times that the control action or manipulation has been performed.

The remote control 400 will be described with reference to FIG. 13.

Figure 13:
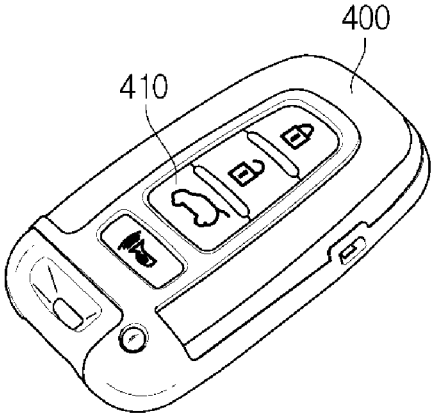
FIG. 13 shows a remote control to communicate with a vehicle having a door operating apparatus according to another form of the present disclosure.

FIG. 13 shows the remote control 400 to communicate with a vehicle having the door operating apparatus, and the remote control 400 performs remote communication with the door operating apparatus built into the vehicle.

The remote control 400 may include a control system 410 of a button type that receives a command to open or close the door.

Once the control system 410 is controlled or manipulated, the remote control 400 sends the control information of the control system 410 to the door operating apparatus in remote signals.

The control information may include control time for which the control system has been pressed, or the number of control times of the control system.

The controller 221 checks the received control information of the control system 410 and determines an open and shut speed corresponding to the control information, and checks the received control information of the remote control 400 and determines an open and shut speed corresponding to the control information.

Again, the control information includes the number of control times or control time of the control system.

The open and shut speed includes a speed at which the door is opened (an open speed) and a speed at which the door is shut (shut speed).

The controller 221 determines a current state of the door, and controls the power member to be driven to open the door at the determined open speed if the door has been shut, or controls the power member to be driven to shut the door at the determined shut speed if the door has been open.

For example, if the number of control times corresponds to one, the controller 221 may set the open and shut speed to be low; if two, middle; if three, high.

Furthermore, if the control time corresponds to approximately 1 second, the controller 221 may set the open and shut speed to be low; if approximately 2 seconds, middle; if approximately 3 seconds, high.

The controller 221 may determine whether the door is open or shut based on whether the door is locked or unlocked.

Furthermore, the controller 221 may also determine whether the door is open or shut based on sensing information from a door-open and shut sensor (not shown).

The controller 221 may output a pulse-width controlled signal corresponding to the determined open and shut speed of the door.

The storage 231 stores open speeds and shut speeds corresponding to the control information items of the control unit and the remote controller.

In other words, the storage 231 may store open and shut speeds corresponding to items of the control time, or items of the number of control times.

If the control information is identical, the open speed and shut speed of the door may be the same.

On the other hand, even if the control information is identical, the open speed and the shut speed may be different.

The driver 240 may drive a motor M arranged in the power member 205 based on a command from the controller 220.

Specifically, the driver 240 may control the rotation speed of the motor M by controlling the pulse width of current or voltage to control current or voltage applied to the motor M.

Accordingly, it may control the door open and shut speed by controlling the speed, whereby the length of the power member that connects the car body and the door is adjusted.

Figure 14:
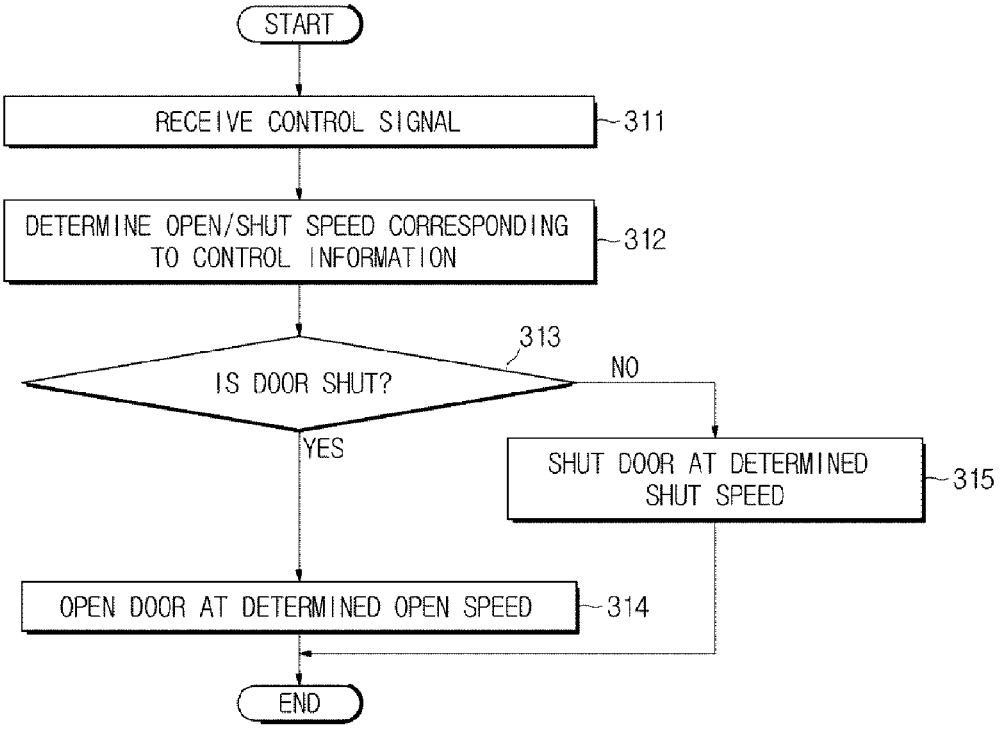
FIG. 14 is a flowchart of controlling a door operating apparatus according to another form of the present disclosure.

FIG. 14 is a flowchart of controlling a door operating apparatus to describe operation of opening and shutting a door of a vehicle.

Upon reception of a control signal from the control unit or the remote control in operation 311, the door operating apparatus of the vehicle obtains control information by processing the control signal, determines an open and shut speed corresponding to the obtained control information in operation 312, and sets the open and shut speed of the door to the determined open and shut speed.

For example, the door operating apparatus determines control time based on the control information, and sets the open and shut speed of the door to be low if the control time is approximately 1 second, middle if approximately 2 seconds, and high if approximately 3 seconds.

In another example, the door operating apparatus determines the number of control times based on the control information, and sets the open and shut speed of the door to be low if the number of control times is one, middle if two, high if three.

Next, the door operating apparatus determines whether the door is currently shut, in operation 313.

Determining the current state of the door includes determining a current state of the door based on whether the latch is locked or unlocked, or determining a current state of the door based on sensing information from the open and shut sensor.

If it is determined that the door is currently shut, the door operating apparatus controls the door to be unlocked and then opened at the determined speed, in operation 314.

Otherwise, if it is determined that the door is currently open, the door operating apparatus shuts the door at the determined shut speed, in operation 315, and controls the door to be locked once the door is shut.

The opening of the door includes stretching the power member that connects the car body and the door, so that moving force is applied to the door in a first direction.

The shutting of the door includes contracting the power member that connects the car body and the door, so that moving force is applied to the door in a second direction.

Increasing the open and shut speed includes increasing a rate at which the length of the power member is changed, by controlling pulse width of current or voltage applied to the motor to increase turning speed of the motor.

Decreasing the open and shut speed includes decreasing a rate at which the length of the power member is changed, by controlling pulse width of current or voltage applied to the motor to decrease turning speed of the motor.

Figure 15:
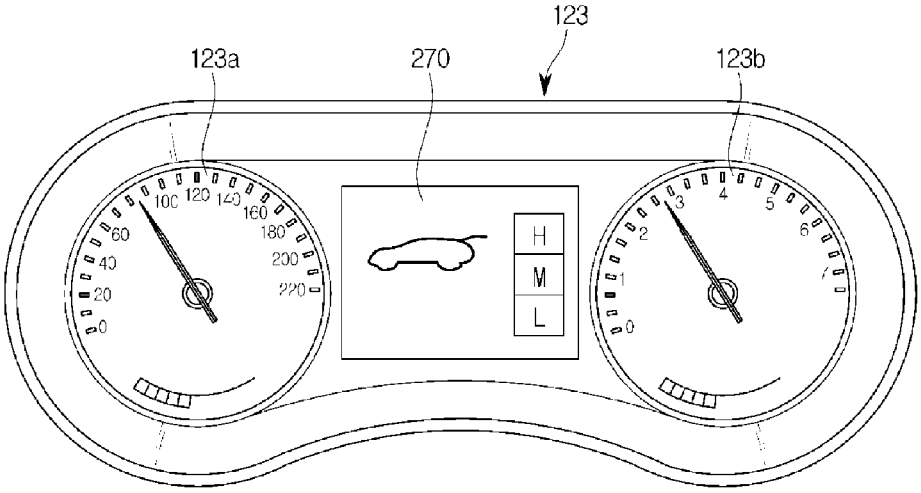
FIG. 15 shows a dashboard of a vehicle equipped with a door operating apparatus according to another form of the present disclosure.

FIG. 15 shows a cluster of a vehicle equipped with a door operating apparatus.

A vehicle includes a cluster 123 that is located on the dashboard and that includes a speedometer 123*a*, a tachometer 123*b*, a water temperature indicator, a fuel gauge, a turn signal indicator, a high beam indicator, a warning lamp (idiot light), a seatbelt warning lamp, an odometer, a treachometer, an automatic gearshift level indicator, a door-open warning lamp, an oil warning light, a low fuel warning light, etc.

The cluster 123 further includes a user interface 270 for receiving a command from the user, outputting information in response to the command from the user, and outputting traveling information of the vehicle.

The user interface 270 may be implemented as a touch screen in which an input unit, which is a touch panel for receiving touch signals, and a display, which is a display panel for outputting image information, may be integrated.

The user interface 270 may receive an open and shut speed of the door from the user and display the input open and shut speed.

Figure 16:
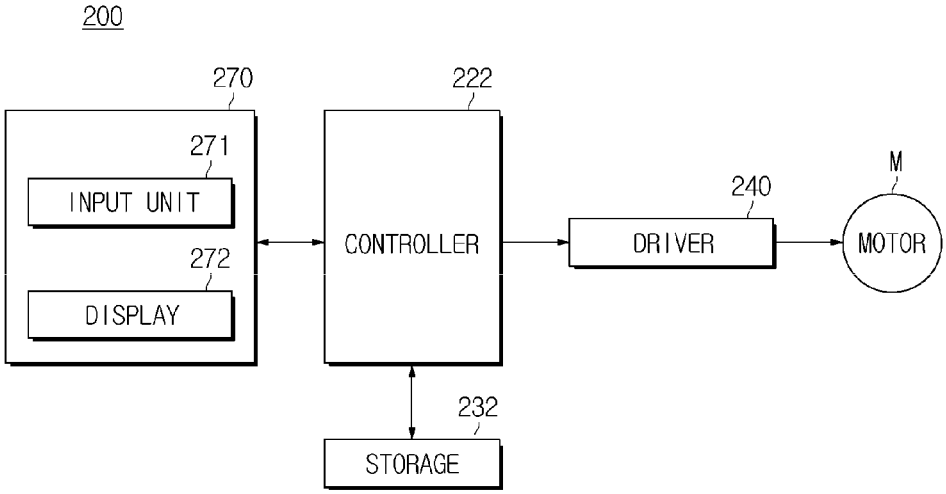
FIG. 16 is a control block diagram of a door operating apparatus according to another form of the present disclosure.

FIG. 16 is a control block diagram of a door operating apparatus for opening or shutting a door of the vehicle having the cluster shown in FIG. 15.

The door operating apparatus 200 may include a user interface 270, a controller 222, a storage 232, and a driver 240.

The user interface 270 may include an input unit 271 for receiving information, and a display 272 for outputting information.

The input unit 271 may send the controller 222 a signal corresponding to a position touched by the user.

The display unit 272 may display indication information items corresponding to selectable open and shut speeds of the door, and may display an indication information item about an open and shut speed selected by the user differently than the other non-selected indication information items, under control of the controller 222.

The controller 222 receives a touch signal from the input unit 271 of the user interface 270, determines a touched position based on the received touch signal, and sets the open and shut speed of the door to an open and shut speed corresponding to an indication information item at the touched position.

The controller 222 determines a current state of the door, and controls the power member to be driven to open the door at the set open speed if the door has been shut, or control the power member to be driven to shut the door at the set shut speed if the door has been open.

For example, the controller 222 may set the open and shut speed of the door to be low if the indication information item at the touched position indicates 'L'; middle if 'M'; high if 'H'.

The controller 222 may determine whether the door is open or shut based on whether the door is locked or unlocked.

Furthermore, it is also possible that the controller 222 determines whether the door is open or shut based on sensing information from a door open and shut sensor (not shown).

The controller 222 may output a pulse-width controlled signal corresponding to the determined open and shut speed of the door.

The door operating apparatus may further include a control unit and a communication unit.

Upon reception of a control signal from the control unit or the remote control, the controller 222 controls the open and shut speed of the door to be the open and shut speed set through the user interface.

The storage 232 stores indication information items corresponding to selectable open and shut speeds, and information items about positions for the indication information items.

For example, the storage 232 stores information items about positions on which 'High', 'Middle', and 'Low' are indicated.

The storage 232 stores open speeds and shut speeds corresponding to the indication information items.

The driver 240 may drive a motor M arranged in the power member 205 based on a command from the controller 220.

Specifically, the driver 240 may control the rotation speed of the motor M by controlling the pulse width of current or voltage to control current or voltage applied to the motor M.

Accordingly, it may control the open and shut speed of the door by controlling the speed at which the power member that connects the car body and the door is stretched.

Figure 17:
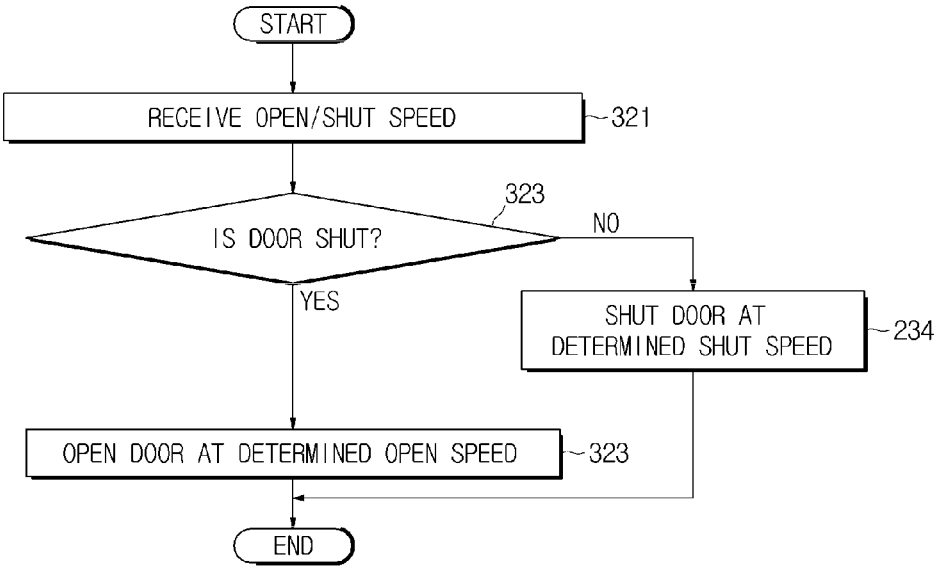
FIG. 17 is a flowchart of controlling a door operating apparatus according to another form of the present disclosure.

FIG. 17 is a flowchart of controlling a door operating apparatus for opening or shutting a door of the vehicle having the cluster shown in FIG. 15.

A user interface arranged on the cluster of the vehicle displays the indication information items, H, M, and L for open and shut speeds that may be selected by the user, once a command to set a door open and shut speed is received.

Once an input signal, which is a touch signal, is received through an input unit of the user interface of the vehicle in operation 321, the door operating apparatus determines a touched position by processing the received touch signal, and recognizes the indication information items H, M, or L corresponding to the determined touched position as input information from the user.

The user interface sends information about an open and shut speed of the door corresponding to the input information to the door open and shut apparatus.

It is also possible for the user interface of the vehicle to send the input information to the door open and shut apparatus.

Upon reception of the open and shut speed information of the door in operation 321, the door open and shut apparatus of the vehicle sets the open and shut speed of the door based on the received information about the open and shut speed information.

Furthermore, once the input information is received, the door open and shut apparatus may determine an open and shut speed corresponding to the received input information, and may set the open and shut speed of the door to the determined open and shut speed.

Next, the door operating apparatus determines whether the door is currently shut, in operation 322.

Determining the current state of the door includes determining a current state of the door based on whether the latch is locked or unlocked, or determining a current state of the door based on sensing information from the open and shut sensor.

If it is determined that the door is currently shut, the door operating apparatus controls the door to be unlocked and then opened at the determined speed, in operation 323.

Otherwise, if it is determined that the door is currently open, the door operating apparatus shuts the door at the determined shut speed, in operation 324, and controls the door to be locked once the door is shut.

The opening of the door includes stretching the power member that connects the car body and the door, so that moving force is applied to the door in a first direction.

The shutting of the door includes contracting the power member that connects the car body and the door, so that moving force is applied to the door in a second direction.

Increasing the open and shut speed includes increasing a rate at which the length of the power member is changed, by controlling pulse width of current or voltage applied to the motor to increase turning speed of the motor.

Decreasing the open and shut speed includes decreasing a rate at which the length of the power member is changed, by controlling pulse width of current or voltage applied to the motor to decrease turning speed of the motor.

Figure 18:
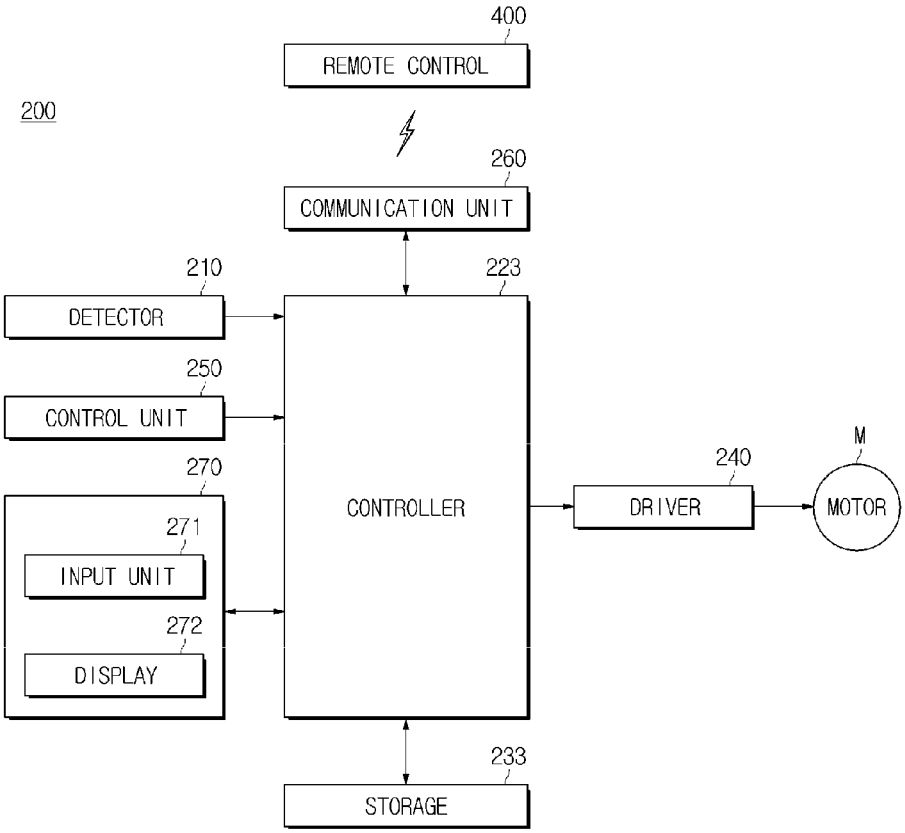
FIG. 18 is a control block diagram of a door operating apparatus according to another form of the present disclosure.

FIG. 18 is a control block diagram of a door operating apparatus.

The door operating apparatus may include a detector 210, a control unit 250, a communication unit 260, a controller 223, a storage 233, and a driver 240, and may communicate with the user interface 270 built into the vehicle.

The detector 210 is the same as what is described above (see FIG. 6), so the description will be omitted.

The control unit 250 and the communication unit 260 are the same as what are described above (see FIG. 8), so the description thereof will also be omitted.

The user interface 270 built into the vehicle may be arranged on the cluster 123.

This will be described with reference to FIGS. 19 and 20.

The cluster 123 includes the speedometer **123*a* and the tachometer 123*b*, and further includes the user interface 270** for receiving a command input from the user, outputting information corresponding to the command input from the user, and outputting traveling information of the vehicle.

The user interface 270 may be implemented as a touch screen in which the input unit 271, which is a touch panel for receiving touch signals, and the display 272, which is a display panel for outputting image information, may be integrated.

Figure 19:
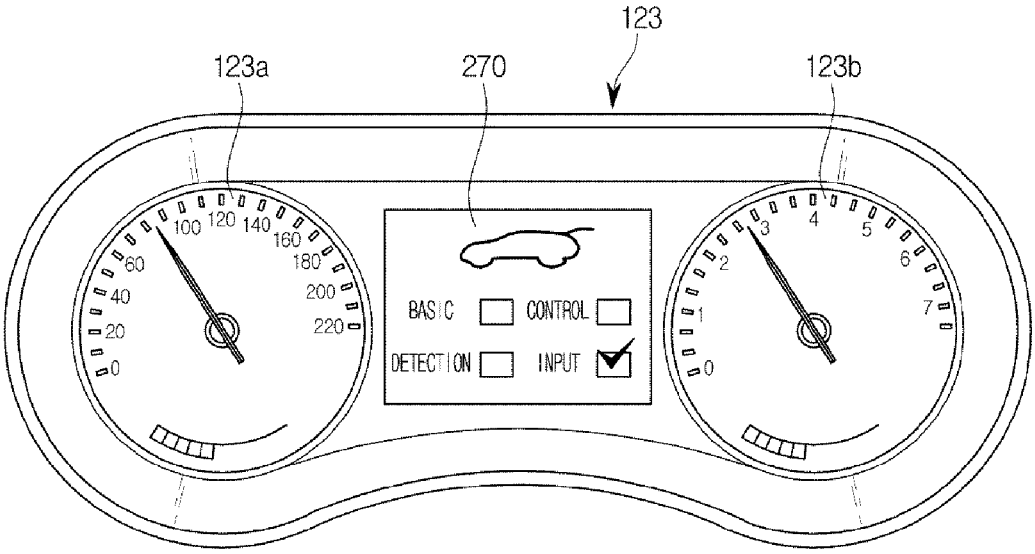
FIGS. 19 and 20 show user interfaces of vehicles equipped with a door operating apparatus according to another form of the present disclosure.
Figure 20:
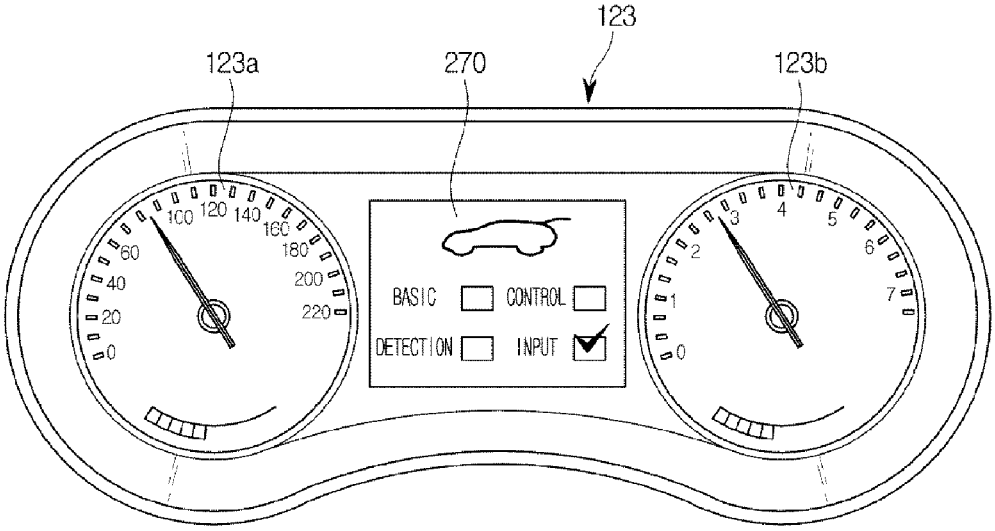

Referring to FIG. 19, the user interface 270 may display setting modes for setting a method for receiving a command to open or shut the door from the user in controlling the open and shut speed of the door, may receive at least one setting mode from the user, and may send the received mode information to the door operating apparatus.

The setting modes may include a basic mode for controlling the open and shut speed of the door to a reference speed, a control mode for controlling the open and shut speed of the door based on control information of the control unit, a detection mode for controlling the open and shut speed of the door based on detection information of the detector, and an input mode for controlling the open and shut speed of the door based on input information of the user interface.

As shown in FIG. 19, if the setting mode corresponds to the input mode, the user interface 270 may display indication information items corresponding to open and shut speeds of the door, may determine an indication information item corresponding to a position touched by the user as input information about an open and shut speed, and may send the input information to the door operating apparatus.

If an input signal of the basic mode is received, the controller 223 may set the open and shut speed of the door to a reference open and shut speed, and if an open and shut command signal is received from the detector 210, the control unit 250, or the remote control 400, the controller 223 may control the power member to open and shut the door at the reference open and shut speed.

If an input signal of the input mode is received, the controller 223 may determine input information sent from the user interface, may determine an open and shut speed corresponding to the input information, may set the open and shut speed of the door to the determined open and shut speed, and may control the power member to open and shut the door at the set open and shut speed once an open and shut command signal is received from the detector, the control unit, or the remote control.

The controller 223 may set the setting mode to the control mode if an input signal of the control mode is received, may determine control information of the control unit, which corresponds to a control signal, if the control signal is received from the control unit, may determine an open and shut speed corresponding to the control information, and may control opening and shutting of the door based on the determined open and shut speed.

Furthermore, if a signal is received from the remote control, the controller 223 may determine control information of the remote control corresponding to the received signal, may determine an open and shut speed corresponding to the determined control information, and may control opening and shutting of the door based on the determined open and shut speed.

The controller 223 may set the setting mode to the detection mode if an input signal of the detection mode is received, may determine a force corresponding to a detection signal if the detection signal is received from the detector, may determine an open and shut speed corresponding to the force, and may control opening and shutting of the door based on the determined open and shut speed.

The controller 223 may set the setting mode to a multimode if input signals of the control mode and detection mode are received, may determine a force corresponding to a detection signal if the detection signal is received from the detector, may determine an open and shut speed corresponding to the force, may control opening and shutting the door based on the determined open and shut speed. Furthermore, if a signal is received from the control unit, the controller 223 may determine control information of the remote control corresponding to the received signal, may determine an open and shut speed corresponding to the determined control information, and may control opening and shutting of the door based on the determined open and shut speed.

If a signal is received from the remote control during the multimode, the controller 223 may determine control information of the remote control corresponding to the received signal, may determine an open and shut speed corresponding to the determined control information, and may control the door based on the determined open and shut speed.

The storage 233 stores information about open and shut speed corresponding to respective information about force, control information, and input information.

The storage 233 stores a reference open and shut speed corresponding to the basic mode.

The driver 240 is the same as what is described above, so the description thereof will be omitted.

Figure 21A:
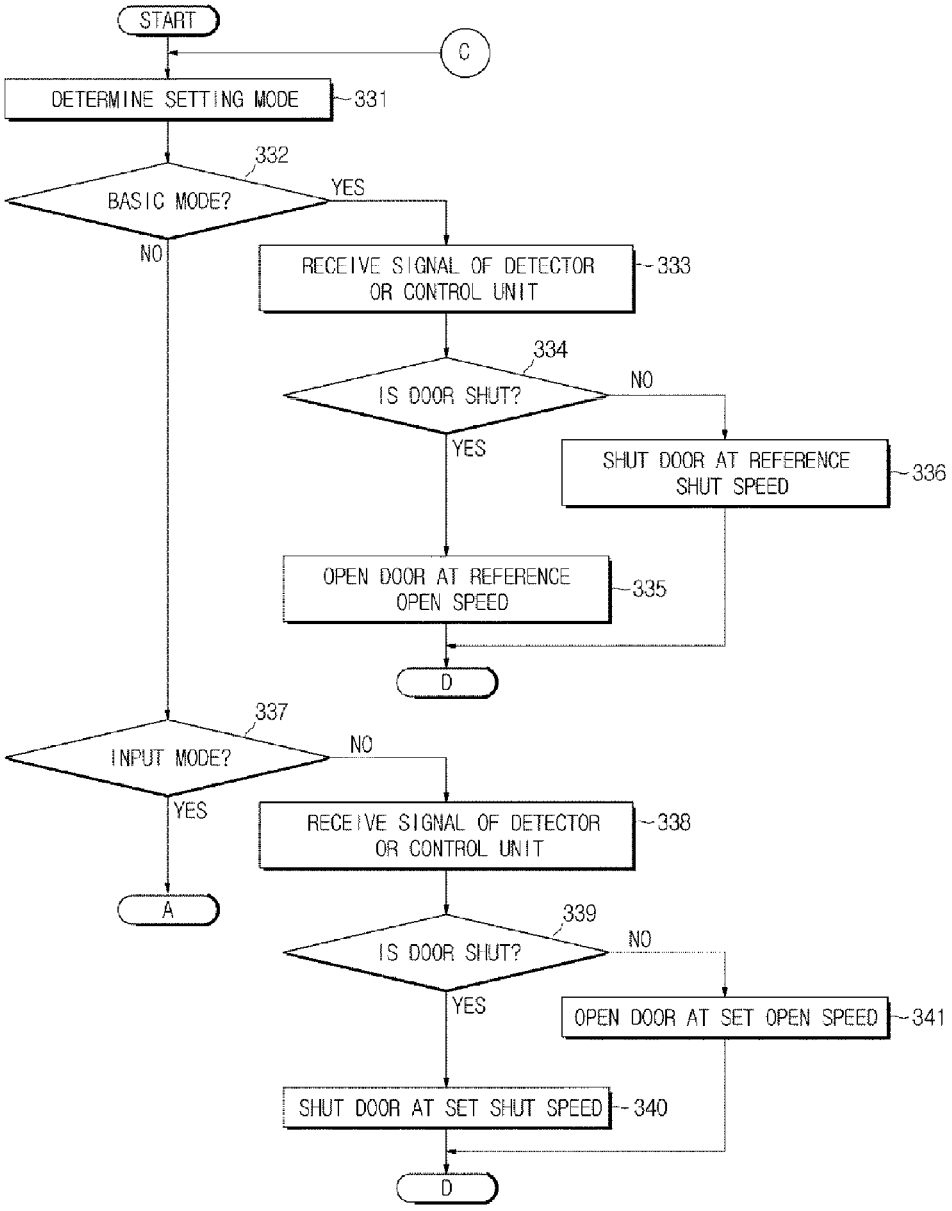
FIGS. 21A, 21B, and 21C are a flowchart of controlling a door operating apparatus according to another form of the present disclosure.
Figure 21B:
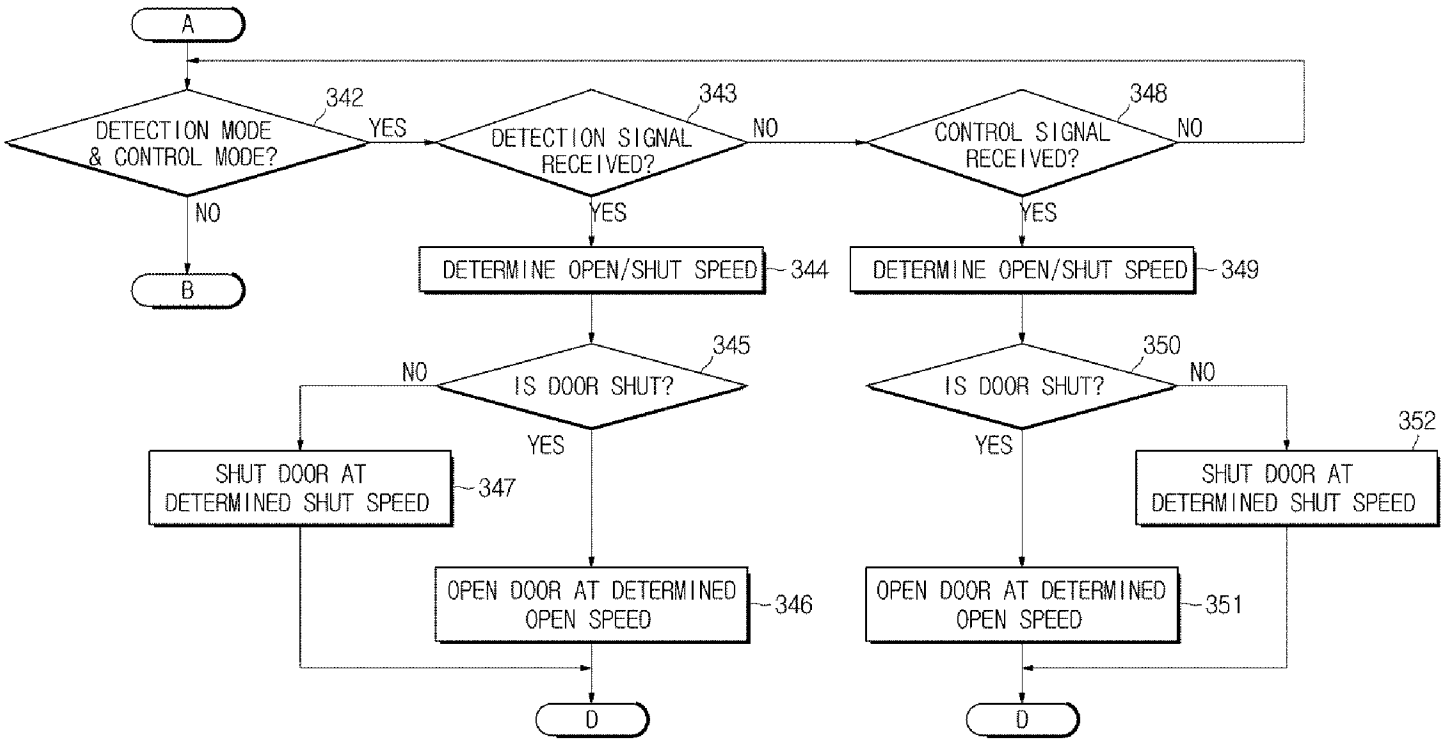
Figure 21C:
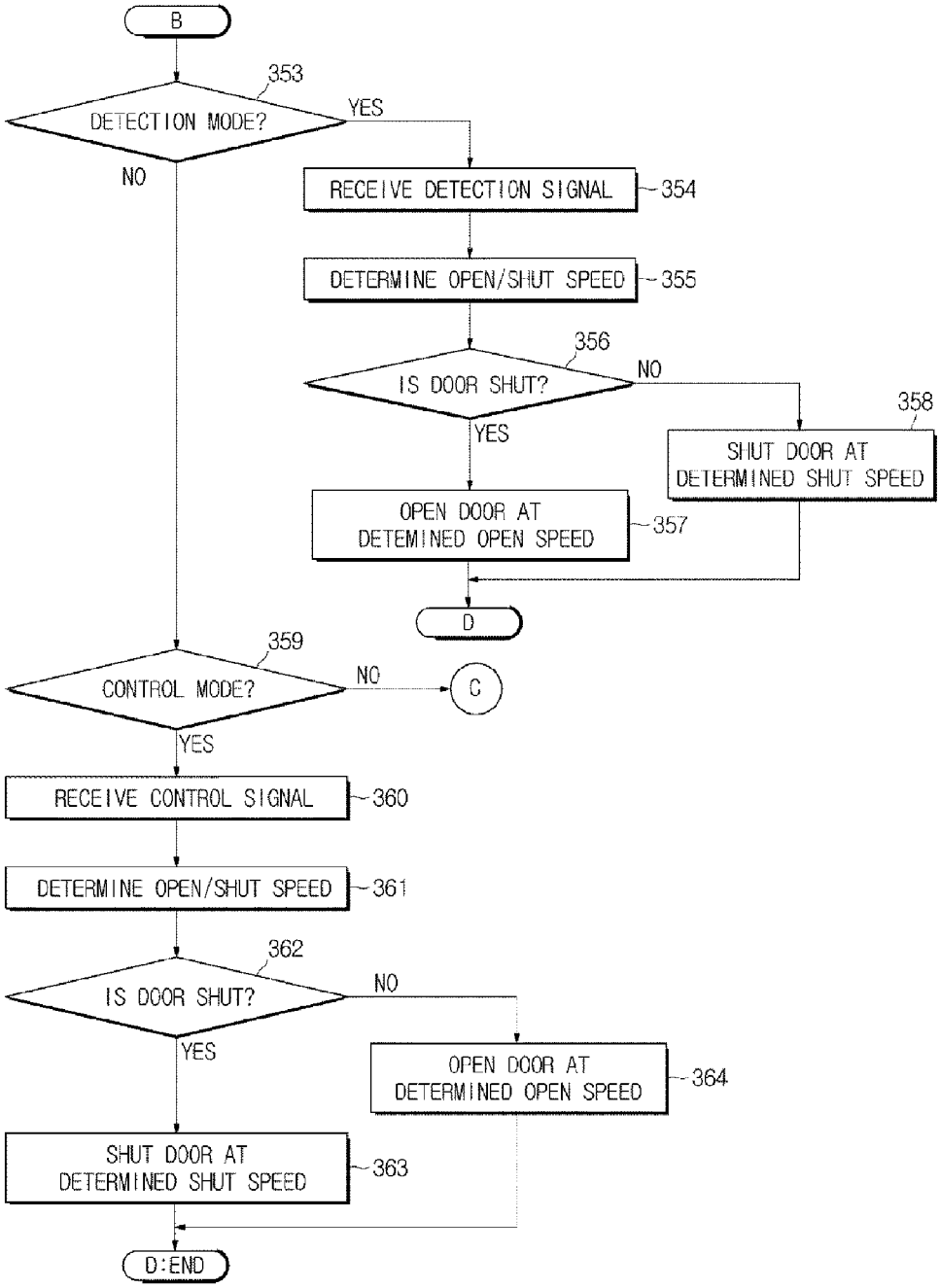

FIGS. 21A, 21B, and 21C are a flowchart of controlling a door operating apparatus.

The door operating apparatus determines a setting mode set through the user interface, in operation 331.

If it is determined that the setting mode is the basic mode in operation 332, the door operating apparatus sets the open and shut speed of the door to the reference open and shut speed.

If an open and shut command signal is received from the detector 210, the control unit 250, or the remote control 400 in operation 333, the door operating apparatus determines whether the door is currently shut in operation 334, and opens the door at the reference open speed in operation 335 if the door is currently shut, and shuts the door at the reference shut speed in operation 336 if the door is currently open.

Opening or shutting the door at the reference open or shut speed includes rotating the motor at a predetermined speed.

The door operating apparatus determines whether the setting mode is the input mode in operation 337 if it is determined that the setting mode is not the basic mode, and determines input information sent from the user interface if it is determined that the setting mode is the input mode, determines an open and shut speed corresponding to the determined input information, and sets the open and shut speed of the door to the determined open and shut speed.

If an open and shut command signal is received from the detector 210, the control unit 250, or the remote control 400 in operation 338, the door operating apparatus determines whether the door is currently shut in operation 339, and opens the door at the set open speed in operation 340 if the door is currently shut, and shuts the door at the set shut speed in operation 341 if the door is currently open.

The door operating apparatus determines whether the setting mode is the multimode in which the control mode and the detection mode are selected together, in operation 342, if the setting mode is not the input mode. If it is determined that the setting mode is the multimode, the door operating apparatus determines whether a signal is received from the detector or the control unit and controls the open and shut speed of the door based on the received signal.

In other words, once a signal is received from the detector in operation 343, the door operating apparatus determines detection information corresponding to the received signal, i.e., information about a force, and determines an open and shut speed corresponding to the force, in operation 344.

Next, the door operating apparatus determines whether the door is currently shut in operation 345, opens the door at the determined open speed in operation 346 if the door is currently shut, and shuts the door at the determined shut speed in operation 347 if the door is currently shut.

If a signal is received from the control unit or the remote control in operation 348, the door operating apparatus determines control information corresponding to the received signal and determines an open and shut speed corresponding to the control information in operation 349.

Next, the door operating apparatus determines whether the door is currently shut in operation 350, opens the door at the determined open speed in operation 351 if the door is currently shut, and shuts the door at the determined shut speed in operation 352 if the door is currently shut.

If the setting mode is not the multimode, the door operating apparatus determines whether one of the detection mode and the control mode has been selected.

Specifically, the door operating apparatus determines whether the setting mode is the detection mode in operation 353, and inactivates the control unit if it is determined that the setting mode is the detection mode.

Once a signal is received from the detector in operation 354, the door operating apparatus determines detection information corresponding to the received signal, i.e., information about a force, and determines an open and shut speed corresponding to the force, in operation 355.

Next, the door operating apparatus determines whether the door is currently shut in operation 356, opens the door at the determined open speed in operation 357 if the door is currently shut, and shuts the door at the determined shut speed in operation 358 if the door is currently shut.

The door operating apparatus determines whether the setting mode is the control mode in operation 359, and inactivates the detector if it is determined that the setting mode is the control mode.

If a signal is received from the control unit or the remote control in operation 360, the door operating apparatus determines control information corresponding to the received signal and determines an open and shut speed corresponding to the control information in operation 361.

Next, the door operating apparatus determines whether the door is currently shut in operation 362, opens the door at the determined open speed in operation 363 if the door is currently shut, and shuts the door at the determined shut speed in operation 364 if the door is currently shut.

As such, the door operating apparatus may control the open and shut speed of the door using various signals.

According to forms of the present disclosure, a car door may be opened or shut at a speed desired by the user, thereby improving user satisfaction.

Furthermore, the speed at which the car door is opened or shut may be controlled so that the noise produced when the door is shut may be reduced.

As such, the present disclosure may increase the quality and marketability of a vehicle as the vehicle has an automatically operating door, and may further increase convenience of the user and safety of the vehicle, thereby securing product competitiveness.

What is claimed is:

1. A door operating apparatus installed in a body for operating a door to open and close an internal room of the body, the door operating apparatus comprising:

a power member connected to the door and configured to apply a moving force to the door;

a detector configured to detect a force applied by a user to the door;

a driver configured to drive the power member;

a storage configured to store opening speeds and closing speeds corresponding to magnitudes of the force;

a controller configured to:

determine a direction in which the force is applied and a magnitude of the force based on information of the detected force, determine an opening speed and a closing speed, among the stored opening and closing speeds, corresponding to the determined magnitude of the force, control the driver to open the door at the determined opening speed when the determined direction is a first direction, and control the driver to close the door at the determined closing speed when the determined direction is a second direction.

2. The door operating apparatus of claim 1, wherein the detector comprises a hall sensor arranged on one side of the power member, the hall sensor configured to output a signal corresponding to a change in position of the power member, and wherein the controller is configured to determine a signal received from the hall sensor while the driver is inactivated as a force from the user.

3. A door operating apparatus installed in a body for operating a door to open and close an internal room of the body, the door operating apparatus comprising:

a power member connected to the door and configured to apply a moving force to the door;

a control unit that is controlled or manipulated by a user;

a storage configured to store opening speeds and closing speeds corresponding to control information of the control unit;

a controller configured to determine an opening speed and a closing speed, among the stored opening and closing speeds, corresponding to control information of the control unit and configured to control the power member to be driven to open and close the door at the determined opening and closing speeds; and a driver configured to drive the power member based on a command from the controller.

4. The door operating apparatus of claim 3, wherein the control information comprises a number of control times which the control unit is controlled, or control time for which the control unit is controlled.

5. The door operating apparatus of claim 3, further comprising a communication unit configured to communicate with a remote control, wherein the controller is configured to determine opening and closing speeds corresponding to control information received by the communication unit from the remote control.

6. A door operating apparatus installed in a body for operating a door to open and close an internal room of the body, the door operating apparatus comprising:

a power member connected to the door and configured to apply a moving force to the door;

a communication unit configured to communicate with a remote control;

a storage configured to store opening speeds and closing speeds corresponding to control information of the remote control;

a controller configured to determine an opening speed and a closing speed, among the stored opening and closing speeds, corresponding to control information of the remote control and configured to control the power member to be driven to open and close the door at the determined opening and closing speeds; and a driver configured to drive the power member based on a command from the controller.

7. The door operating apparatus of claim 6, wherein the control information comprises a number of control times which the remote control is controlled, or control time for which the remote control is controlled.

8. A vehicle comprising:

a car body;

a door installed on the car body for opening and closing an internal room; and a door operating apparatus configured to automatically open and close the door, wherein the door operating apparatus comprises:

a power member connected to the door and configured to apply a moving force to the door, a detector configured to detect a force applied by a user to the door, a driver configured to drive the power member, a storage configured to store opening speeds and closing speeds corresponding to magnitudes of the force, and a controller configured to:

determine a direction in which the force is applied and a magnitude of the force based on information of the detected force, determine an opening speed and a closing speed, among the stored opening and closing speeds, corresponding to the determined magnitude of the force, control the driver to open the door at the determined opening speed when the determined direction is a first direction, and control the driver to close the door at the determined closing speed when the determined direction is a second direction.

9. The vehicle of claim 8, wherein the detector comprises a hall sensor arranged on one side of the power member and configured to output a signal corresponding to a change in position of the power member.

10. The vehicle of claim 8, wherein the door operating apparatus further comprises a communication unit configured to communicate with a remote control, and wherein the controller is configured to determine an opening speed and a closing speed corresponding to control information received by the communication unit from the remote control.

11. A vehicle comprising:

a car body;

a door installed on the car body for opening and closing an internal room; and a door operating apparatus configured to automatically open and close the door, wherein the door operating apparatus comprises:

a power member connected to the door and configured to apply a moving force to the door, a control unit controlled or manipulated by a user, a controller configured to control the power member to be driven to open and close the door at an opening speed and a closing speed corresponding to control information of the control unit, a driver configured to drive the power member based on a command from the controller, and a control system arranged in an overhead console or on a center fascia of the internal room, and configured to receive a command to open and close the door.

12. The vehicle of claim 11, wherein the door operating apparatus further comprises a communication unit configured to communicate with a remote control, and wherein the controller is configured to determine an opening speed and a closing speed corresponding to control information received by the communication unit from the remote control.

13. The vehicle of claim 11, wherein the control unit comprises at least one of a control system arranged in a handle of the door, or a control system arranged in a panel of the door.

14. The vehicle of claim 11, further comprising a user interface arranged on a cluster in the internal room and configured to receive an opening speed and a closing speed of the door.

15. The vehicle of claim 11, further comprising a detector configured to detect a force applied by the user to the door, and wherein the controller is configured to determine an opening speed and a closing speed corresponding to the detected force.

16. The vehicle of claim 15, wherein the control system comprises a user interface arranged on a cluster of the internal room, and configured to input or output open and shut setting information for the door, wherein the open and shut setting information for the door comprises at least one of open and shut settings according to control of the control unit, detection of the detector, input through the user interface, or a reference speed.

17. A method for controlling operation of a door of a vehicle to open and close an internal room of the vehicle, the method comprising:

determining, by a controller, an opening speed and a closing speed of the door corresponding to information input by a control system;

controlling by the controller a power member arranged in the door to open the door at the determined opening speed when the door is closed; and controlling by the controller the power member to close the door at the determined closing speed when the door is open, wherein the control system is arranged in an overhead console or on a center fascia of the internal room, and the control system is manipulated by a user.

18. The method of claim 17, further comprising: detecting a force applied by the user to the door by means of a detector, and determining an opening speed and a closing speed corresponding to the detected force.

19. The method of claim 17, wherein the determining the opening and closing speeds of the door corresponding to the information input comprises:

determining an opening speed and a closing speed corresponding to control information input by the user to a control unit;

determining an opening speed and a closing speed corresponding to information input by the user to a user interface; and determining an opening speed and a closing speed corresponding to control information input by the user to a remote control.

* * * * *